US006467865B1

(12) United States Patent
Iwamura et al.

(10) Patent No.: US 6,467,865 B1
(45) Date of Patent: Oct. 22, 2002

(54) INK JET RECORDING HEAD AND INK JET RECORDER

(75) Inventors: Takuya Iwamura; Masakazu Okuda, both of Tokyo (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 09/744,475

(22) PCT Filed: Jul. 26, 1999

(86) PCT No.: PCT/JP99/03994

§ 371 (c)(1),
(2), (4) Date: Jan. 25, 2001

(87) PCT Pub. No.: WO00/06387

PCT Pub. Date: Feb. 10, 2000

(30) Foreign Application Priority Data

Jul. 29, 1998 (JP) ..... 10-214164

(51) Int. Cl.[7] ..... B41J 29/38
(52) U.S. Cl. ..... 347/14; 347/11
(58) Field of Search ..... 347/14, 11, 9

(56) References Cited

U.S. PATENT DOCUMENTS

| | | | | |
|---|---|---|---|---|
| 4,176,361 A | | 11/1979 | Kawada et al. | |
| 5,130,726 A | | 7/1992 | Fukushima et al. | 346/140 |
| 5,581,281 A | * | 12/1996 | Fuse | 347/14 |
| 5,644,341 A | * | 7/1997 | Fujii et al. | 347/11 |
| 5,739,828 A | * | 4/1998 | Moriyama et al. | 347/9 |
| 5,838,350 A | * | 11/1998 | Newcombe | 347/68 |
| 5,877,785 A | * | 3/1999 | Iwasaki et al. | 347/14 |
| 6,109,715 A | | 8/2000 | Masaki | |
| 6,109,716 A | * | 8/2000 | Takahashi | 347/11 |
| 6,217,159 B1 | | 4/2001 | Morikoshi et al. | |

FOREIGN PATENT DOCUMENTS

| | | |
|---|---|---|
| EP | 0 250 271 | 12/1987 |
| EP | 0 385 417 | 9/1990 |
| EP | 0 787 589 | 8/1997 |
| JP | 55-017589 | 2/1980 |
| JP | 59-143653 | 8/1984 |

(List continued on next page.)

OTHER PUBLICATIONS

Kimura, Y., "On–demand type ink jet recording apparatus," Patent Abstracts of Japan, 59–176055, Oct. 5, 1984, (Abstract only).

Moriyama, J., "Liquid jet recording apparatus," Patent Abstracts of Japan, 2–253960, Mar. 29, 1989, (Abstracts only).

*Primary Examiner*—Thinh Nguyen

(57) ABSTRACT

Ink stored in an ink tank 11 passes through a supply path 12 and supply port 13 and fills a pressure chamber 14. A piezoelectric actuator 15 vibrates a vibration plate 17 by receiving a voltage from a driving voltage control unit 16. The volume of the pressure chamber 14 is changed by vibrating the vibration plate 17 to eject the ink in the pressure chamber 14 from a nozzle 18 toward to the sheet 2. The diameter of the nozzle 18 is set within the range of 20 to 40 $\mu$m, and an ink viscosity is set within the range of 2 to 6 mPa·s. With these settings, a fine droplet having the total diameter of 25 $\mu$m or less can be stably ejected, thereby obtaining high quality image. In addition, a driving waveform voltage is corrected in accordance with the ambient temperature detected by a temperature detection unit 19, and the ink viscosity is set within the range of 2 to 15 mPa·s, thereby keeping high image quality.

6 Claims, 5 Drawing Sheets

FOREIGN PATENT DOCUMENTS

| | | | |
|---|---|---|---|
| JP | 62-035849 | | 2/1987 |
| JP | 62-240555 | | 10/1987 |
| JP | 63-071355 | | 3/1988 |
| JP | 02-192947 | | 7/1990 |
| JP | 02-253960 | | 10/1990 |
| JP | 6-305134 | A | 11/1994 |
| JP | 07-148920 | | 6/1995 |
| JP | 09-169111 | | 6/1997 |
| JP | 9-194780 | A | 7/1997 |
| JP | 09-201962 | | 8/1997 |
| JP | 9-277560 | A | 10/1997 |
| JP | 10-24570 | A | 1/1998 |
| JP | 10-034914 | | 2/1998 |
| JP | 10-166567 | A | 6/1998 |
| JP | 10-193620 | A | 7/1998 |
| WO | 94/26522 | | 11/1994 |
| WO | 95/25011 | | 9/1995 |

* cited by examiner

INK JET RECORDING HEAD AND INK JET RECORDER

TECHNICAL FIELD

The present invention relates to an ink jet recording head and ink jet recording apparatus and, more particularly, to an ink jet recording head for recording characters or an image on a sheet by generating a pressure change in a pressure chamber filled with ink by using a pressure generation means, and ejecting an ink droplet from a nozzle of the pressure chamber after adding an operation for retracting a meniscus indicating an ink surface of a nozzle opening deep inside the nozzle immediately before the ejection to change a meniscus shape into a concave shape, and an ink jet recording apparatus having this ink jet recording head.

BACKGROUND ART

An ink jet recording head of this type is used for an ink jet recording apparatus used as a printer, plotter, copying apparatus, facsimile apparatus, or the like.

Upon printing to a recording medium such as a sheet, a pressure chamber having a nozzle for ejecting ink is filled with ink, and a pressure chamber generation means such as a piezoelectric actuator is driven to generate a pressure change in the pressure chamber. The ink is ejected from the nozzle to the recording medium such as a sheet by this pressure change, thereby printing desired characters or a desired image.

In recent years, a demand has arisen for printing output quality. To meet this, stable ejection of an ink droplet with the small diameter has been required. To decrease an ejection ink droplet diameter, it is effective to make a nozzle diameter small, but this poses problems such as the difficulty in manufacturing a nozzle and the like.

To solve such problems, a means for ejecting a fine droplet with the diameter smaller than a nozzle diameter by adding a "pull" process to a driving waveform and changing a meniscus shape into a concave shape immediately before the ejection is considered and disclosed in, e.g., Japanese Patent Laid-Open No. 55-17589. FIGS. 14A to 14C show ejection processes by meniscus control. While no ejection is required, a state shown in FIG. 14A has been kept. When the ejection is required, first, an electrical pulse is applied to a piezoelectric actuator so as to increase the internal volume of a pressure chamber to change a meniscus shape into a concave shape, as shown in FIG. 14B. Then, an electrical pulse is applied to the piezoelectric actuator so as to decrease the internal volume of the pressure chamber to eject an ink droplet, as shown in FIG. 14C.

A method of changing an ejection ink droplet diameter by changing a "pull" strength and timing is also disclosed in Japanese Patent Laid-Open No. 59-143653.

According to this reference, there are provided an additional pulse voltage application means for applying to a nozzle an additional pulse voltage having a polarity opposite to that of a main pulse voltage to determine the front end position of a liquid before applying the main pulse voltage, and an additional pulse voltage regulation means for regulating a voltage level or width of the additional pulse. In addition, there is also provided a main pulse voltage application timing adjustment means for adjusting a timing from the end of additional pulse voltage application to the start of main pulse voltage application.

A method of stabilizing an ink droplet ejection state by changing a "pull" strength in accordance with the ambient temperature is also disclosed in Japanese Patent Laid-Open No. 2-253960.

According to this reference, there are provided a temperature measurement means for measuring an ink temperature, and an additional pulse voltage regulation means for regulating a voltage level or width of an additional pulse in accordance with the measured temperature.

In such an ink jet recording head, however, a sufficiently fine droplet cannot be ejected, droplet formation is very unstable, or an ejection failure occurs, depending on the viscosity of ink to be used. Therefore, high-quality printing can not be performed It is therefore an object of the present invention to provide an ink jet recording head and ink jet recording apparatus having the ink jet recording head, in which a stable, fine droplet can be ejected in printing, and a printing output can be performed with high quality.

DISCLOSURE OF INVENTION

An ink jet recording head according to the present invention is an ink jet recording head for generating a pressure change in a pressure chamber filled with ink by using pressure generation means, and ejecting an ink droplet from a nozzle of the pressure chamber after adding an operation for retracting a meniscus deep inside the nozzle immediately before the ejection to change a meniscus shape into a concave shape, wherein a viscosity of the ink within a temperature range in which an apparatus is used is not less than 2 mPa·s.

In the present invention, the viscosity of the ink within the temperature range in which the apparatus is used is not more then 6 mPa·s.

In the present invention, a temperature detection unit for detecting ambient temperature is included, a driving voltage generated by a driving voltage control unit constructing the pressure generation means is corrected in accordance with a change in the ambient temperature detected by the temperature detection unit, and the viscosity of the ink within the temperature range in which the apparatus is used is not more than 15 mPa·s.

In the present invention, a minimum total diameter of the ink droplet is not more than 25 $\mu$m.

In the present invention, a diameter of the nozzle falls within the range of 20 to 40 $\mu$m.

In the present invention, a driving voltage generated by the driving voltage control unit and used to change the meniscus shape of the ink into the concave shape is corrected in accordance with a viscosity change in the ink depending on a change in the ambient temperature.

In the present invention, a driving voltage generated by the driving voltage control unit and used to change the meniscus shape of the ink into the concave shape and a driving voltage generated by the driving voltage control unit and used to eject the ink are corrected in accordance with a viscosity change of the ink depending on a change in the ambient temperature.

In the present invention, a driving voltage generated by the driving voltage control unit and used to change the meniscus shape of the ink into the concave shape and a driving voltage generated by the driving voltage control unit and used to eject the ink are corrected at the same magnification in accordance with a viscosity change of the ink depending on a change in the ambient temperature.

In the present invention, a driving voltage generated by the driving voltage control unit and used to change the meniscus shape of the ink into the concave shape does not exceed an offset voltage of a driving waveform.

An ink jet recording apparatus according to the present invention is an ink jet recording apparatus for printing by generating a pressure change in a pressure chamber filled with ink by using pressure generation means, and ejecting an ink droplet from a nozzle of the pressure chamber after adding an operation for retracting a meniscus deep inside the nozzle immediately before the ejection to change a meniscus shape into a concave shape, wherein a viscosity of the ink within a temperature range in which the apparatus is used is not less than 2 mPa·s.

In the ink jet recording apparatus of the present invention, the viscosity of the ink within the temperature range in which the apparatus is used is not more then 6 mPa·s.

The ink jet recording apparatus of the present invention, a temperature detection unit for detecting ambient temperature is included, a driving voltage generated by a driving voltage control unit constructing the pressure generation means is corrected in accordance with a change in the ambient temperature detected by the temperature detection unit, and the viscosity of the ink within the temperature range in which the apparatus is used is not more than 15 mPa·s.

In the ink jet recording apparatus of the present invention, a driving voltage generated by the driving voltage control unit and used to change the meniscus shape of the ink into the concave shape is corrected in accordance with a viscosity change in the ink depending on a change in the ambient temperature.

In the ink jet recording apparatus of the present invention, a driving voltage generated by the driving voltage control unit and used to change the meniscus shape of the ink into the concave shape and a driving voltage generated by the driving voltage control unit and used to eject the ink are corrected in accordance with a viscosity change of the ink depending on a change in the ambient temperature.

In the ink jet recording apparatus of the present invention, a driving voltage generated by the driving voltage control unit and used to change the meniscus shape of the ink into the concave shape and a driving voltage generated by the driving voltage control unit and used to eject the ink are corrected at the same magnification in accordance with a viscosity change of the ink depending on a change in the ambient temperature.

In the ink jet recording apparatus of the present invention, a driving voltage generated by the driving voltage control unit and used to change the meniscus shape of ink into the concave shape does not exceed an offset voltage of a driving waveform.

BEST MODE OF CARRYING OUT THE INVENTION

Embodiments of the present invention will be described below with reference to the accompanying drawings.

Figure 1:
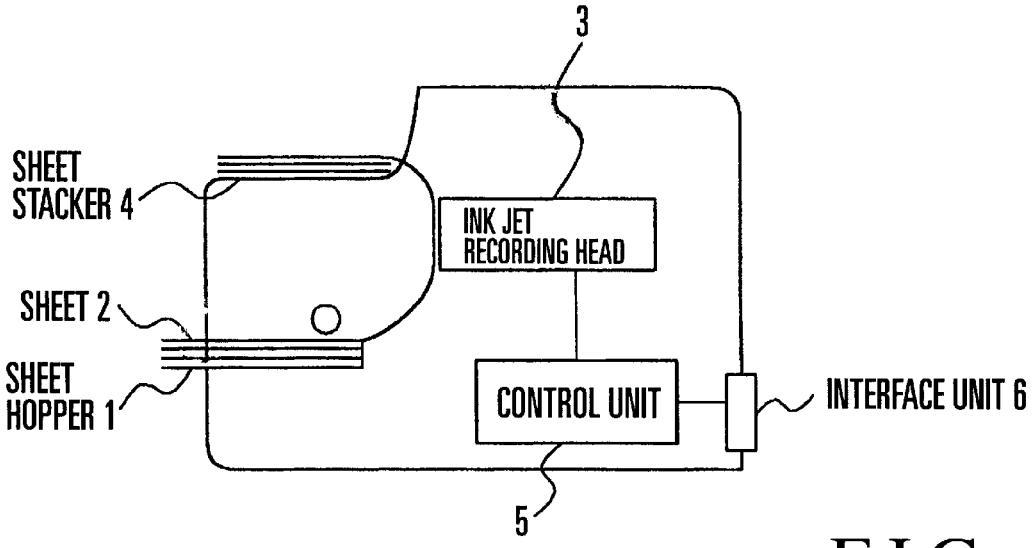
FIG. 1 is a schematic view showing a section of an ink jet recording apparatus according to the present invention.

FIG. 1 is a sectional view showing the arrangement of an ink jet recording apparatus according to the first embodiment of the present invention. An ink jet recording apparatus is used as a printer, plotter, copying apparatus, facsimile apparatus, or the like. The ink jet recording apparatus shown in FIG. 1 is a printer and includes a sheet hopper 1, ink jet recording head 3, sheet stacker 4, control unit 5, and interface unit 6.

The ink jet recording head 3 is attached to a carrier (not shown). The ink jet recording head 3 scans in a direction perpendicular to the convey direction of a sheet 2. The sheet 2 is supplied from the sheet hopper 1, and desired characters and image are printed on the sheet 2 by the ink jet recording head 3. The printed sheet 2 is then discharged to the sheet stacker 4. The control unit 5 controls these operations. The interface unit 6 is connected to a host apparatus such as a personal computer to receive the signal from the host apparatus.

If the ink jet recording apparatus is a facsimile apparatus, the interface unit 6 is connected to a communication line, and the apparatus includes a scanner for inputting an image to be transmitted.

If the ink jet recording apparatus is a copying apparatus, the apparatus includes a scanner for inputting an image to be copied. The interface unit 6 may not be required.

Figure 2:
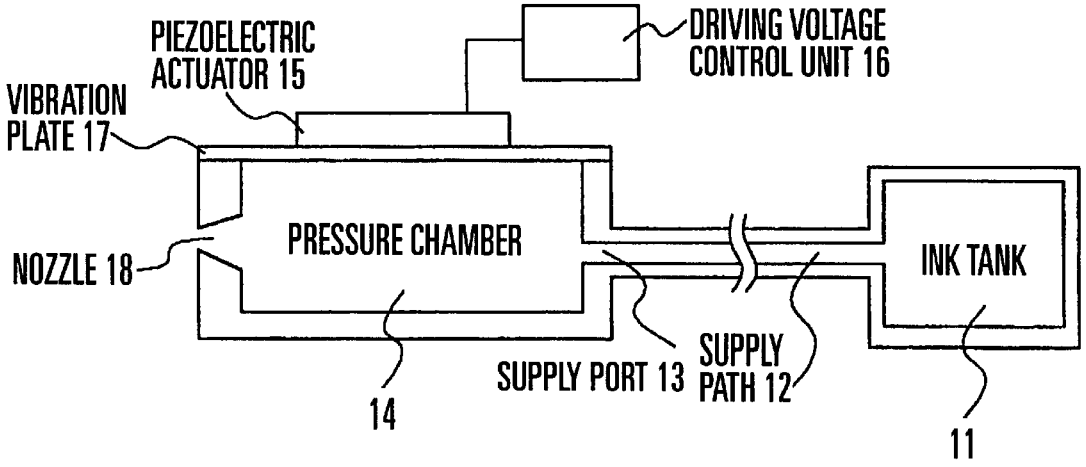
FIG. 2 is a block diagram showing an ink jet recording head constructing the ink jet recording apparatus according to the first embodiment.

FIG. 2 is a block diagram showing the arrangement of the ink jet recording head 3. Ink stored in an ink tank 11 passes through a supply path 12 and supply port 13 and fills a pressure chamber 14. A piezoelectric actuator 15 vibrates a vibration plate 17 by receiving a voltage from a driving voltage control unit 16. When the vibration plate 17 is vibrated, the volume of the pressure chamber 14 changes, and the ink in the pressure chamber 14 is ejected from a nozzle 18 toward to the sheet 2.

To obtain high image quality in the actual printing, the diameter of an ink droplet ejected from a nozzle need be decreased. Accordingly, the present inventors conducted a recording experiment while changing the ejected ink droplet diameter, and fifty persons performed subjective evaluation about image quality, thereby obtaining the following conclusion as a result. To obtain smooth image quality such that coarseness is not noticeable even in a highlight (low density) portion where the human conspicuously perceives coarse grains, a total ejection ink droplet diameter need be set at 25

μm or less. This means that a point at which the human eye does not perceive coarse grains is close to a total ejection ink droplet diameter of 25 μm, and becomes an index when an ink jet recording head or ink jet recording apparatus is designed. Note that, in the present specification, a total ejection ink droplet diameter is a converted diameter when the volume of a combination of a main droplet and satellite (a fine particle occurring around the main droplet) is regarded as a sphere.

If a nozzle diameter is made to small, the total diameter of a possible minimum ink droplet is set small. However, the nozzle tends to clog caused by drying ink, mixing dust, or the like, thereby degrading the reliability of the ink jet recording head. Since manufacturing difficulty increases so that manufacturing variation occurs between nozzles, the ink droplet ejection speeds and droplet diameters (main droplet diameter and satellite diameter) vary between the nozzles or the ink jet recording apparatuses at a high probability or rate. In addition, if the nozzle diameter is made smaller while paying attention to only the maximum ink droplet, the ejection of the maximum ink droplet corresponding to the desired resolution becomes difficult. Accordingly, the nozzle diameter has a practical lower limit.

Note that, the natural period of a pressure wave in the pressure chamber 14 in a state in which the pressure chamber 14 is filled with the ink is set within the range of 5 to 30 μsec, and most preferably, within the range of 5 to 20 μsec. To stably eject the small ink droplet, the natural period is preferably decreased, however, a decrease in natural period makes it difficult to eject the large ink droplet. For this reason, the natural period of the pressure wave in the pressure chamber 14 is set in the range described above, thereby ejecting the small to large droplets with good balance.

A decrease in thickness of the vibration plate 17 improves an efficiency of conversion from the driving energy to a pressure. Since, however, the thin vibration plate 17 is difficult to manufacture, its thickness is preferably set within the range of 10 to 50 μm.

The piezoelectric actuator 15 has about ten layers each having an inner electrode formed on a piezoelectric material having a predetermined thickness and stacked. The thickness of the piezoelectric material layer is decided in accordance with a driving voltage applied from a driving power source. When the driving voltage is about 40 V, the thickness of one layer is preferably set at about 40 μm.

If the ejection is performed only a "push" process without adding a "pull" process to the driving waveform, the total diameter of a possible minimum ink droplet can be decreased at most to a size equal to that of the nozzle diameter. To eject the ink droplet having the diameter smaller than that of the nozzle, the "pull" process need be added to the driving waveform.

Figure 3:
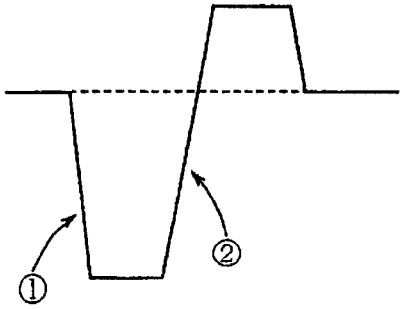
FIG. 3 is a view showing a driving waveform voltage of the recording head according to the first embodiment.

FIG. 3 is a view showing a driving waveform voltage input to a piezoelectric actuator. A meniscus shape is changed into a concave shape at the pull portion of ①, and the ink droplet is ejected by applying an ejection energy shown at the push portion of ② at a predetermined timing. A fine droplet having a size smaller than that of the nozzle diameter can be ejected by meniscus control in which the "pull" and "push" processes are performed.

As described above, particularly in dot graytone recording (droplet diameter modulation), the range in which the ejection ink droplet diameter can be changed can be widened, and as needed, the driving waveform added with the "pull" process is used. Accordingly, a dot diameter is modulated in the multiple levels ranging from a fine droplet having a diameter smaller than that of the nozzle to a large droplet generating no gap between dots upon solid-printing, thereby implementing graytone printing in a wide density range. In the driving added with the "pull" process, however, the diameter of a nozzle to be used also has an upper limit to satisfy the restriction on the minimum ink droplet setting, in which the total droplet diameter is set at 25 μm or less.

The present inventors manufactured a recording head whose nozzle was changed between the 10 μm to 60 μm and conducted an ink droplet ejection experiment. The present inventors examined the manufacturing reliability described above and stability of ink jet recording head performance, and the restriction on the minimum ink droplet described above. As a result, it was obvious that an appropriate nozzle diameter satisfying these conditions fell within the range of 20 μm to 40 μm.

In this meniscus control, ejection characteristics (a droplet diameter and droplet speed) are changed depending on a retraction amount of a meniscus immediately before the ejection. Thus, when the meniscus control is performed, it becomes sensitive to various variation factors as compared with that in the ordinary ejection without using the "pull" process. In addition, since the meniscus is vibrated before the "push" process is added to eject an ink droplet, it is difficult to decide the retraction amount of the meniscus in a single nozzle due to influences of ejection hysteresis of the previous dot, crosstalk, use environment, and the like. As a result, the ejection ink droplet is susceptible to variation.

Figure 13:
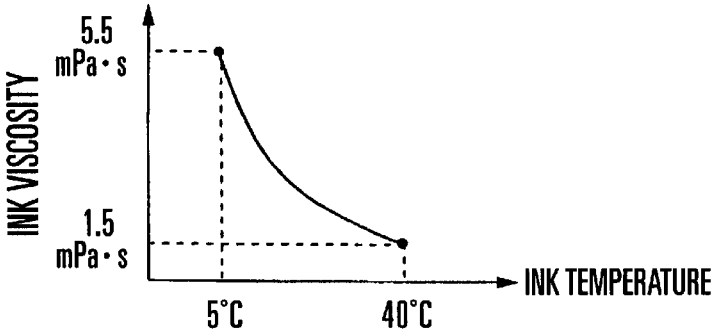
FIG. 13 is a graph showing a change in ink viscosity with respect to an ink temperature.
Figures 14A, 14B, 14C:
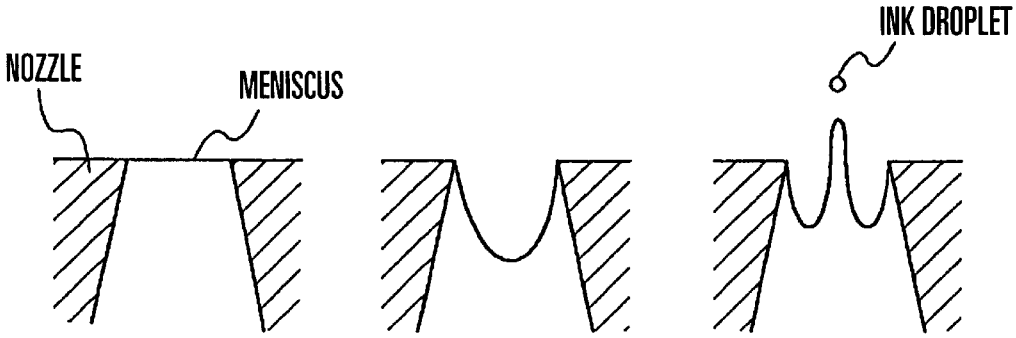
FIGS. 14A, 14B, and 14C are views showing ejection processes by meniscus control.

The present inventors pay attention to an ink viscosity change that is considered as a large variation factor for the retraction amount of the meniscus. The ink viscosity is greatly varied with respect to the ambient temperature such as an environmental temperature in which the apparatus is installed or a temperature in the apparatus. As shown in FIG. 13, for example, when the ink temperature raises from 5° C. to 40° C., the ink viscosity decreases from 5.5 mPa·s to 1,5 mPa·s.

The present inventors examined first specific influences of various types of phenomena occurring at near the nozzle on the ink viscosity change, and confirmed the following facts. Since the ink fluidity becomes high upon decreasing the ink viscosity, an action on the meniscus surface becomes unstable stepwisely. In particularly, when the ink viscosity becomes less than 2 mPa·s, the influence in droplet formation becomes conspicuous. In this state, not only the diameters of the main droplet and satellite and the speed of them become unstable, but the abnormally ejected satellite attaches to a nozzle plate to cause an ejection failure. In some cases, the unstable state stops ejection. In addition to this, in the range of the ink viscosity of 2 mPa·s or less, the difference in formation of ink droplets between nozzles increases beyond an allowable range because even a small manufacturing error of each nozzle tends to be reflected. Further, a deviation in ejection direction of an ink droplet caused by remaining ink on an edge of a nozzle, and a bubble retracted inside the nozzle after the ink droplet ejection become conspicuous.

Figure 4:
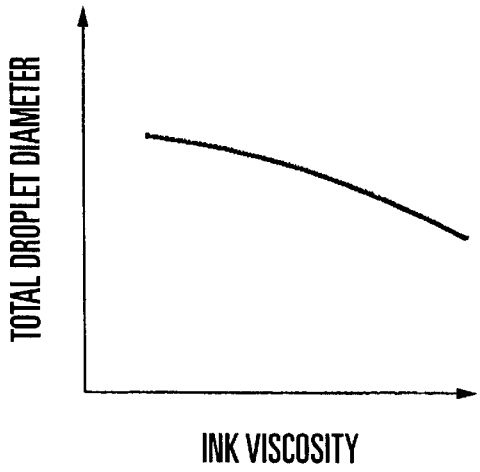
FIG. 4 is a graph showing a change in total ejection ink droplet diameter upon changing an ink viscosity.
Figure 5:
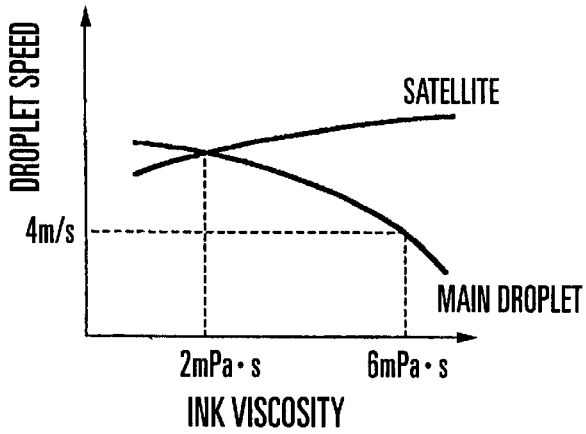
FIG. 5 is a graph showing a change in ejection ink droplet speed upon changing the ink viscosity.

The present inventors further examined influences on the ejection characteristics with respect to the ink viscosity change. FIG. 4 is a graph showing a change in total ejection droplet diameter when an ink viscosity is changed, and FIG. 5 is a graph showing a change in ejected ink droplet speed when the ink viscosity is changed. Referring to FIGS. 4 and 5, upon increasing the ink viscosity, the total droplet diameter decreases, the main droplet speed decreases, and the satellite speed increases. At the point where the magnitudes of the main droplet speed and satellite speed cross each other, the ink viscosity is 2 mPa·s. If the ink viscosity is this value or less, the main droplet and satellite are not combined and kept separated from each other until landing on a sheet, thereby causing image quality degradation. From the reasons described above, the viscosity of ink to be used need have the lower limit of 2 mPa·s.

On the other hand, when the ink viscosity becomes high, the total droplet diameter and main droplet speed decrease, as described above, color tone becomes unbalance, and linearity of a dot array degrades. It has been obvious from the aforementioned examination that this causes image quality degradation. According to the result of another experiment conducted by the present inventors with respect to the relationship between the ejection characteristics and landing precision, the minimum main droplet speed required to obtain a sufficiently landing precision in the fine droplet ejection is 4 m/s. In addition to this, to keep the image quality by obtaining uniform dot diameters, the viscosity of ink to be used need have the upper limit of 6 mPa·s, as described in FIG. 5.

As has been described above, the ink viscosity within the temperature range in which the apparatus is used is obviously set within the range of 2 to 6 mPa·s, thereby stably ejecting a fine droplet with the total droplet diameter of as small as 25 μm or less.

As a method of adjusting the ink viscosity, a viscosity modifier is generally added to ink. As the viscosity modifier, a polyvalent alcohol compound is frequently used. Of the polyvalent alcohol compounds, polyethylene glycol (the molecular weight of 200 to 800) is very effective as the viscosity modifier because polyethylene glycol does not affect physical properties (surfaces tension, density, pH, and the like) excepting for the viscosity and arbitrarily adjusts only the viscosity. The content of the viscosity modifier to be added is changed depending on a solvent of ink or the other additives, however, the viscosity modifier is generally added in an amount of about 0.1 to 10% with respect to the ink amount.

The second embodiment of the present invention will be described below. The second embodiment is different from the first embodiment in the arrangement of the ink jet recording head and a driving voltage control scheme.

Figure 6:
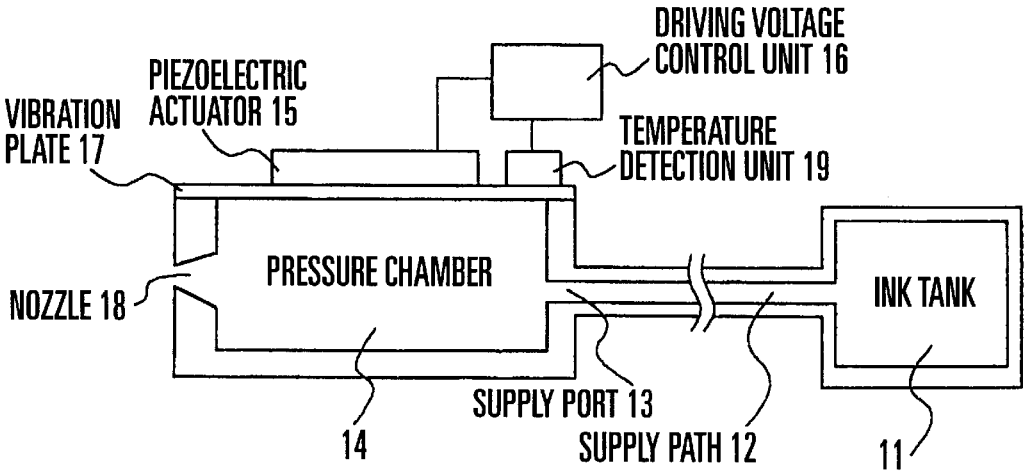
FIG. 6 is a block diagram showing an ink jet recording head constructing the ink jet recording apparatus according to the second embodiment.

FIG. 6 is a block diagram showing an arrangement of an ink jet recording head according to the second embodiment, in which a temperature detection unit 19 is included in addition to the arrangement of the ink jet recording head according to the first embodiment shown in FIG. 2.

Figure 7:
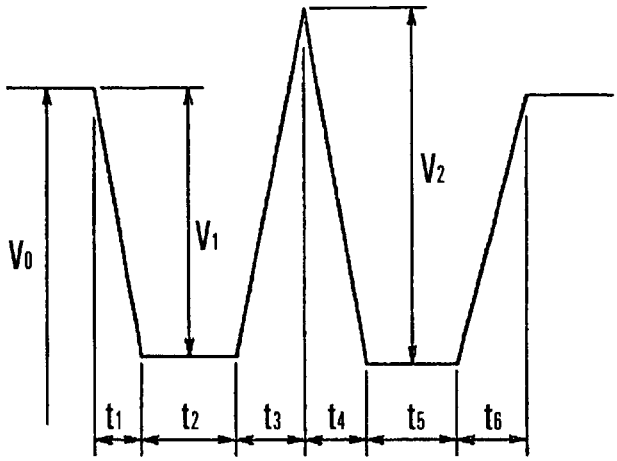
FIG. 7 is a view showing a driving waveform voltage of the recording head according to the second embodiment.

FIG. 7 is a view showing a driving waveform voltage input to a piezoelectric actuator. Excepting for the ejection operation time, an offset voltage V0 is kept applied to the piezoelectric actuator. Reference symbol V1 denotes a "pull" voltage; and V2, a "push" voltage. Reference symbols t1 to t6 denote the times. If the value of V1 is set large in addition to the V0, a portion at which the driving waveform voltage shifts from positive to negative voltages is formed. When the piezoelectric actuator is driven under this condition, a polarized state of the piezoelectric actuator is inversed. This causes a phenomenon in which the displacement of the piezoelectric actuator is greatly decreased in the subsequently driving. In addition, the cost of a power source for driving the ink jet recording head increases because both positive and negative voltages are required. Thus, the value of V1 is preferably set without exceeding the value of V0.

Upon setting the ink viscosity at 3.5 mPa·s, V0=10V, V1=6V, V2=8V, t1=3 μs, t2=5 μs, t3=2 μs, t4=2 μs, t5=2 μs, and t6=2 μs. In this setting, a fine droplet having the total droplet diameter of 20 μm or less, which is smaller than that shown in the first embodiment, can be stably ejected, thereby obtaining higher image quality.

Figure 8:
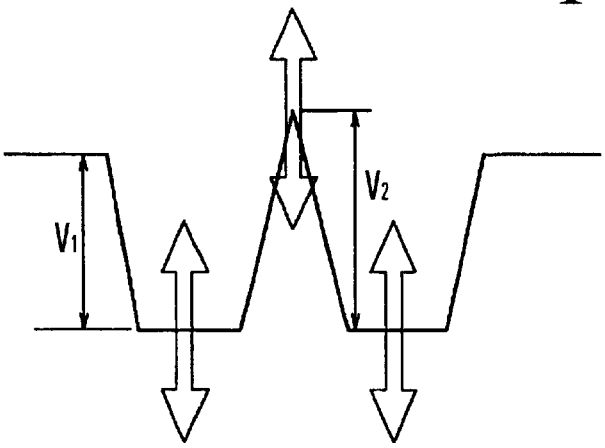
FIG. 8 is a view showing a driving waveform voltage correction method of the recording head according to the second embodiment.
Figure 9:
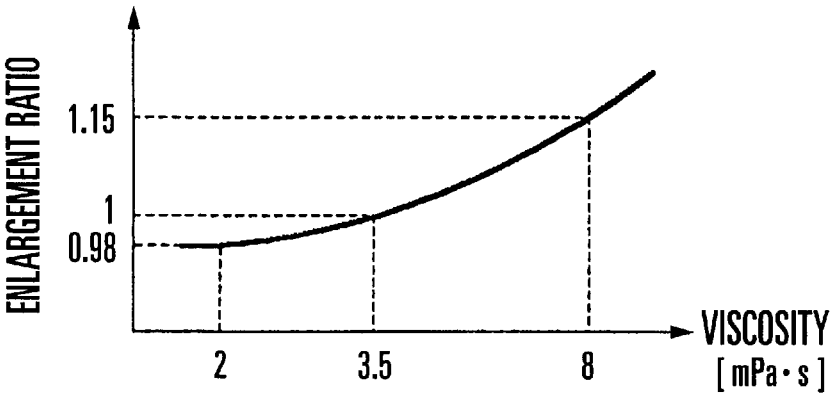
FIG. 9 is a graph showing a driving waveform voltage correction factor with respect to the ink viscosity.
Figure 10:
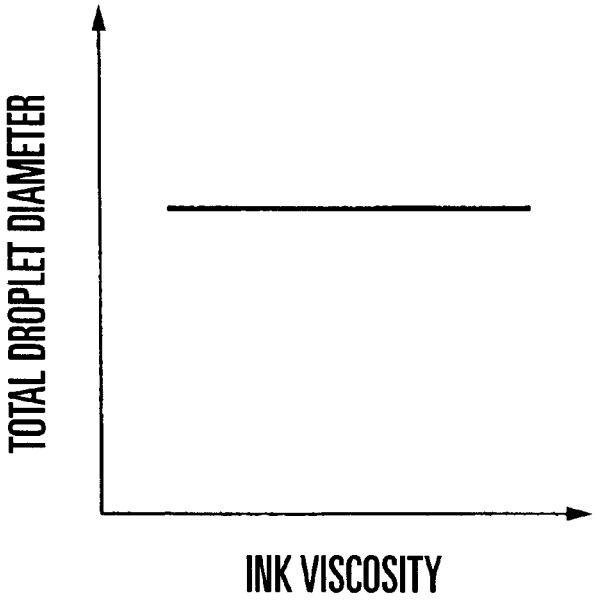
FIG. 10 is a graph showing a change in total ejection ink droplet diameter after driving waveform voltage correction.

As described in the first embodiment by using FIGS. 4 and 5, when an ink viscosity is changed upon changing the ambient temperature, the ejection characteristics are changed. To suppress this change, correction is performed by simultaneously increasing or decreasing the driving voltages V1 and V2, as shown in FIG. 8, in accordance with the ambient temperature change detected by the temperature detection unit 19. As a result of obtaining a correction factor in an experiment conducted by the present inventors such that a main droplet speed becomes constant, the correction factor for the ink viscosity shown in FIG. 9 was obtained. The inventors also corrected the V1 and V2 in accordance with the correction factor curve shown in FIG. 9 at the same magnification, thereby obtaining ejection characteristics such as a predetermined or smaller total droplet diameter shown in FIG. 10, and a constant main droplet speed shown in FIG. 11.

Figure 11:
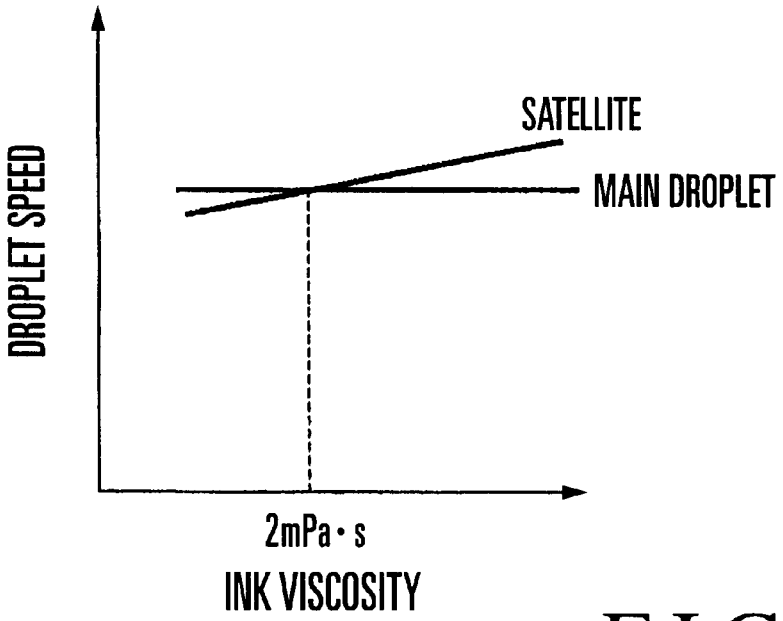
FIG. 11 is a graph showing a change in ejection ink droplet speed after driving waveform voltage correction.

As is obvious from the comparison between FIGS. 5 and 11, even after the driving waveform voltage is corrected, a point at which the relationship in magnitude between the main droplet speed and satellite speed is reversed with respect to the ink viscosity change corresponds to the ink viscosity of 2 mPa·s. Accordingly, even after the driving waveform voltage is corrected, the lower limit of the viscosity of ink to be used is 2 mPa·s. Accordingly, even after the driving waveform voltage correction, the lower limit of the viscosity of ink to be used is also 2 mPa·s.

Figure 12:
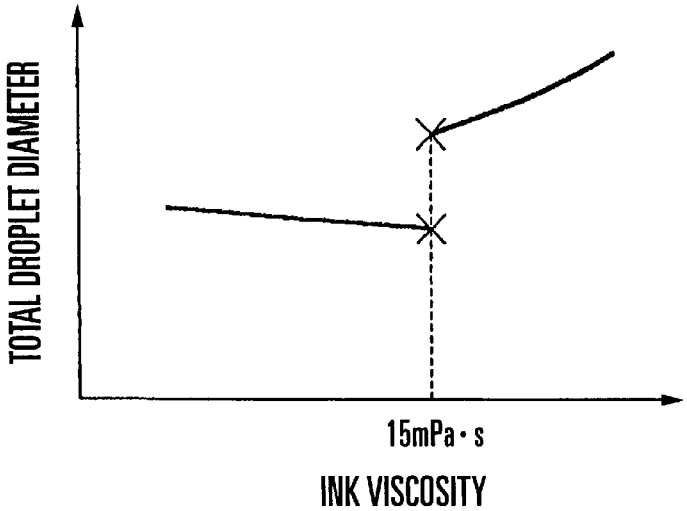
FIG. 12 is a graph showing a change in total ejection ink droplet diameter after driving waveform voltage correction when the ink viscosity is high.

On the other hand, the inspection is performed at a portion where the ink viscosity is high. When the ink viscosity is increased while changing the correction factor such that the main droplet speed becomes constant, as shown in FIG. 12, the total droplet diameter tends to slightly decrease. This means that a thinner liquid column is produced by increasing the curvature of the central portion of a meniscus with an increase in ink viscosity.

After that, when the ink viscosity is further increased, the total droplet diameter discontinuously increases at a point where the ink viscosity is 15 mPa·s. In an ink viscosity exceeding 15 mPa·s, the total droplet diameter also increases upon increasing the ink viscosity. This is because a second satellite is undesirably given the energy enough to be ejected from the nozzle by increasing the correction factor upon increasing the ink viscosity, i.e., by increasing the driving waveform voltage. The second satellite is mainly produced by a pressure wave reaction and has a droplet speed very slower than that of the main droplet or a first satellite, and a diameter larger than that of the main droplet or a first satellite. The second satellite production thus greatly degrades image quality. Accordingly, the upper limit of the viscosity of ink to be used is 15 mPa·s.

As described above, when the driving waveform voltage is corrected, the ink viscosity within the temperature range in which the apparatus is used is set within the range of 2 to 15 mPa·s. With this setting, even a fine droplet such as a droplet having a total droplet diameter of 25 μm or less can be stably ejected with the constant droplet speed and predetermined or smaller total droplet diameter.

Industrial Applicability

As has been described above, in the ink jet recording head and ink jet recording apparatus according to the present invention, the ink viscosity within the temperature range in which the apparatus is used is set within the range of 2 to 6 mPa·s. In addition, when the driving waveform voltage is to be corrected in accordance with the ambient temperature, the ink viscosity within the temperature range in which the apparatus is used is set within the range of 2 to 15 mPa·s. With both settings, the fine droplet with the total droplet diameter of 25 μm or less can be stably ejected. As a result, a printing output with high quality can be obtained, and, if the present invention is applied to a printer, plotter, copying apparatus, facsimile apparatus, or the like, a high-quality image and characters can be printed thereby.

What is claimed is:

1. An ink jet recording head comprising:

a pressure chamber for holding ink, the pressure chamber having a nozzle having a diameter within a range of 20 to 40 μm;

a pressure generation means having a driving voltage control unit for generating first and second driving voltages, a vibration plate bonding to said pressure chamber for changing a volume of said pressure chamber on the basis of vibration, and an actuator for vibrating said vibration plate upon receiving the first and second driving voltages, for generating a pressure change in said pressure chamber to eject an ink droplet from the nozzle, the ink droplet having a minimum total diameter of not more than 20 μm;

a temperature detection unit for detecting ambient temperature; and a correction means for correcting the first and second driving voltages generated by said driving voltage control unit in accordance with a change in the ambient temperature detected by said temperature detection unit, wherein said pressure generation means retracts a meniscus indicating an ink liquid surface of a nozzle opening to change a meniscus shape into a concave shape by causing the driving voltage control unit to generate the first driving voltage having a level smaller than the absolute value of an offset voltage applied to the actuator that is not being operated and larger than 0V to operate the nozzle, before ejecting the ink droplet from the nozzle, and then ejects the ink droplet from the nozzle by causing said driving voltage control unit to generate the second driving voltage having a level larger than the absolute value of the offset voltage to operate said actuator, and wherein said correction means corrects the first and second driving voltages generated by the driving voltage control unit at the same magnification in accordance with a viscosity change of the ink depending on the change in the ambient temperature.

2. An ink jet recording head according to claim 1, wherein a viscosity of the ink within a temperature range in which an apparatus is used is not less than 2 mPa·s.

3. An ink jet recording apparatus comprising:

an ink jet recording head having a pressure chamber for holding ink, the pressure chamber having a nozzle having a diameter within a range of 20 to 40 μm;

a pressure generation means having a driving voltage control unit for generating first and second driving voltages, a vibration plate bonding to the pressure chamber for changing a volume of the pressure chamber on the basis of vibration, and an actuator for vibrating the vibration plate upon receiving the first and second driving voltages, for generating a pressure change in the pressure chamber to eject an ink droplet from the nozzle, the ink droplet having a minimum total diameter of not more than 20 μm;

a temperature detection unit for detecting ambient temperature; and a correction means for correcting the first and second driving voltages generated by the driving voltage control unit in accordance with a change in the ambient temperature detected by the temperature detection unit, _o1 wherein the pressure generation means retracts a meniscus indicating an ink liquid surface of a nozzle opening to change a meniscus shape into a concave shape by causing the driving voltage control unit to generate the first driving voltage having a level smaller than the absolute value of an offset voltage applied to the actuator that is not being operated and larger than 0V to operate the nozzle, before ejecting the ink droplet from the nozzle, and then ejects the ink droplet from the nozzle by causing the driving voltage control unit to generate the second driving voltage having a level larger than the absolute value of the offset voltage to operate the actuator, and wherein the correction means corrects the first and second driving voltages generated by the driving voltage control unit at the same magnification in accordance with a viscosity change of the ink depending on the change in the ambient temperature.

4. An ink jet recording apparatus according to claim 3, wherein a viscosity of the ink within a temperature range in which said apparatus is used is not less than 2 mPa·s.

5. An ink jet recording apparatus according to claim 3, wherein a viscosity of the ink within a temperature range in which said apparatus is used is not more then 15 mPa·s.

6. An ink jet recording head according to claim 1, wherein a viscosity of the ink within a temperature range in which an apparatus is used is not more then 15 mPa·s.

* * * * *